US005305997A

United States Patent [19]

Jolly

[11] Patent Number: 5,305,997

[45] Date of Patent: Apr. 26, 1994

[54] BASKETBALL RIM ASSEMBLY

[76] Inventor: James Jolly, Glen Dean, Ky. 40141

[21] Appl. No.: 822,489

[22] Filed: Jan. 14, 1992

[51] Int. Cl.[5] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 1,387,418 | 8/1921 | Lillibridge | 273/1.5 R |
| 2,049,593 | 8/1936 | Schabinger | 273/1.5 R |
| 3,194,555 | 7/1965 | Humphrey | 273/1.5 R |
| 3,752,477 | 8/1973 | Hoyt | 273/1.5 R |
| 4,071,238 | 1/1978 | Chapman | 273/1.5 R |
| 4,082,269 | 4/1978 | Hill | 273/1.5 R |
| 4,111,420 | 9/1978 | Tyner | 273/1.5 R |
| 4,285,518 | 8/1981 | Pearo | 273/1.5 R |
| 4,348,022 | 9/1982 | O'Donnell | 273/1.5 R |
| 4,353,548 | 10/1982 | Mahoney | 273/1.5 R |
| 4,365,802 | 12/1982 | Ehrat | 273/1.5 R |
| 4,433,839 | 2/1984 | Simonseth | 273/1.5 R |
| 4,441,709 | 4/1984 | Schroeder et al. | 273/1.5 R |
| 4,534,556 | 8/1985 | Estlund et al. | 273/1.5 R |
| 4,676,503 | 6/1987 | Mahoney | 273/1.5 R |
| 4,834,368 | 5/1989 | Qualley | 273/1.5 R |
| 5,098,091 | 3/1992 | McGivern | 273/1.5 R |

FOREIGN PATENT DOCUMENTS

| | | | |
|---|---|---|---|
| 1214739 | 12/1970 | United Kingdom | 273/1.5 R |

*Primary Examiner*—Paul E. Shapiro

*Attorney, Agent, or Firm*—Hughes & Multer

[57] ABSTRACT

The basketball rim assembly of the present invention basically comprises: (a) a rim portion; (b) a mounting portion adapted to be attached to a backboard; and (c) bolts for detachably attaching the rim portion to the mounting portion. Preferably, one or more first bolts are provided which extend through holes in the rim portion and which are attached to the mounting portion and one or more second bolts are provided which extend through holes in the mounting portion and which are attached to the rim portion.

13 Claims, 6 Drawing Sheets

BASKETBALL RIM ASSEMBLY

TECHNICAL FIELD

The present invention relates to basketball rim assemblies for suspending a basketball rim from a basketball backboard.

BACKGROUND OF THE INVENTION

The traditional basketball rim assembly is a simple unitary device designed be bolted or otherwise rigidly affixed to a basketball backboard. When excessive loads are applied to the rim of a traditional rim assembly, such as by a basketball player executing a "slam dunk", the rim may bend and become unusable. Since the traditional rim assembly is simply and inexpensively constructed with no moving parts, the entire rim assembly is normally replaced when bent.

If the traditional rim assembly is connected to a glass backboard, excessive loads applied to the rim thereof can shatter the glass backboard, resulting in a safety hazard to players in the vicinity of the backboard. This problem of shattering the glass backboard has been alleviated in large part by the introduction of breakaway rim assemblies. Breakaway rim assemblies generally incorporate: (a) a detent system which allows the rim to deflect when a predetermined load is applied to the rim thereof; and (b) a damping spring arranged to absorb or damp the shock of the loads applied to the rim and return the rim to its original position.

While breakaway rim assemblies have been generally successful at preventing shattered glass backboards, the rims thereof still have a tendency to bend when subjected to excessive loads. Following the practice of replacing the entire rim assembly established with traditional rim assemblies, the entire breakaway assembly is normally replaced when the rim thereof becomes bent. However, because breakaway rim assemblies are rather complex, they are relatively expensive in comparison to the traditional rim assembly. Thus, the cost of replacing an entire breakaway rim assembly each time the rim thereof is bent can be as much as four or five times the cost of replacing a traditional rim assembly.

Additionally, known rim assemblies employ fasteners referred to as "ram's horn" fasteners to attach the basketball net to the rim. These ram's horn fasteners are a single piece of rigid wire bent into the general shape of a ram's horn having a center loop and two end portions. The end portions are normally welded to the underside of the rim, while a loop of basketball net is placed around, and held by, the center loop. These ram's horn fasteners pose a safety hazard to players whose hands are near the basketball rim. Specifically, the tip of a jumping player's finger may become jammed between the center loop and either of the two end portions of the ram's horn fastener, resulting in injury to the player when he begins to return to the ground. This problem is especially acute along the front portion of the rim.

OBJECTS OF THE INVENTION

In view of the foregoing, it is apparent that an important object of the present invention is to provide an improved basketball rim assembly.

Another important, but more specific, object of the present invention is to provide a basketball rim assembly having a favorable mix of the following factors:

a. reducing the cost of repairing basketball rims bent by the application of excessive downward forces thereon;
b. reducing the likelihood that player's will injure themselves on the net fastening system of the rim assembly;
c. allowing adjustment of the angle at which the basketball rim extends relative to the backboard to which and the playing surface above which it is attached; and
d. allowing direct transmission of downward loads on the basketball rim to a breakaway rim apparatus that allows the rim to deflect when excessive downward forces are applied thereto.

SUMMARY OF THE INVENTION

The basketball rim assembly of the present invention basically comprises:(a) a rim portion; (b) a mounting portion adapted to be attached to a backboard; and (c) means for detachably attaching the rim portion to the mounting portion. Preferably, the attaching means comprises one or more first bolts which extend through holes in the rim portion and which are attached to the mounting portion and further comprises one or more second bolts which extend through holes in the mounting portion and which are attached to the rim portion.

In the preferred embodiment, the attaching means further comprises a projection formed on one of the rim portion and the mounting portion and a recess means formed on the other of the rim portion and the mounting portion for receiving the projection in a manner that allows loads applied to the rim portion to be transmitted directly to the mounting portion.

To allow adjustment of the rim portion, the first bolts are attached to the mounting portion by a cylindrical adjustment sleeve having threaded inner and outer surfaces, where the inner surface receives a threaded portion of the bolt and the outer surface is received within a threaded hole in the mounting portion.

The present invention is perhaps most useful when the mounting portion contains means for allowing the rim portion to deflect when excessive loads are applied to the rim portion.

DETAILED DESCRIPTION OF THE PREFERRED EMBODIMENT

Figure 1:
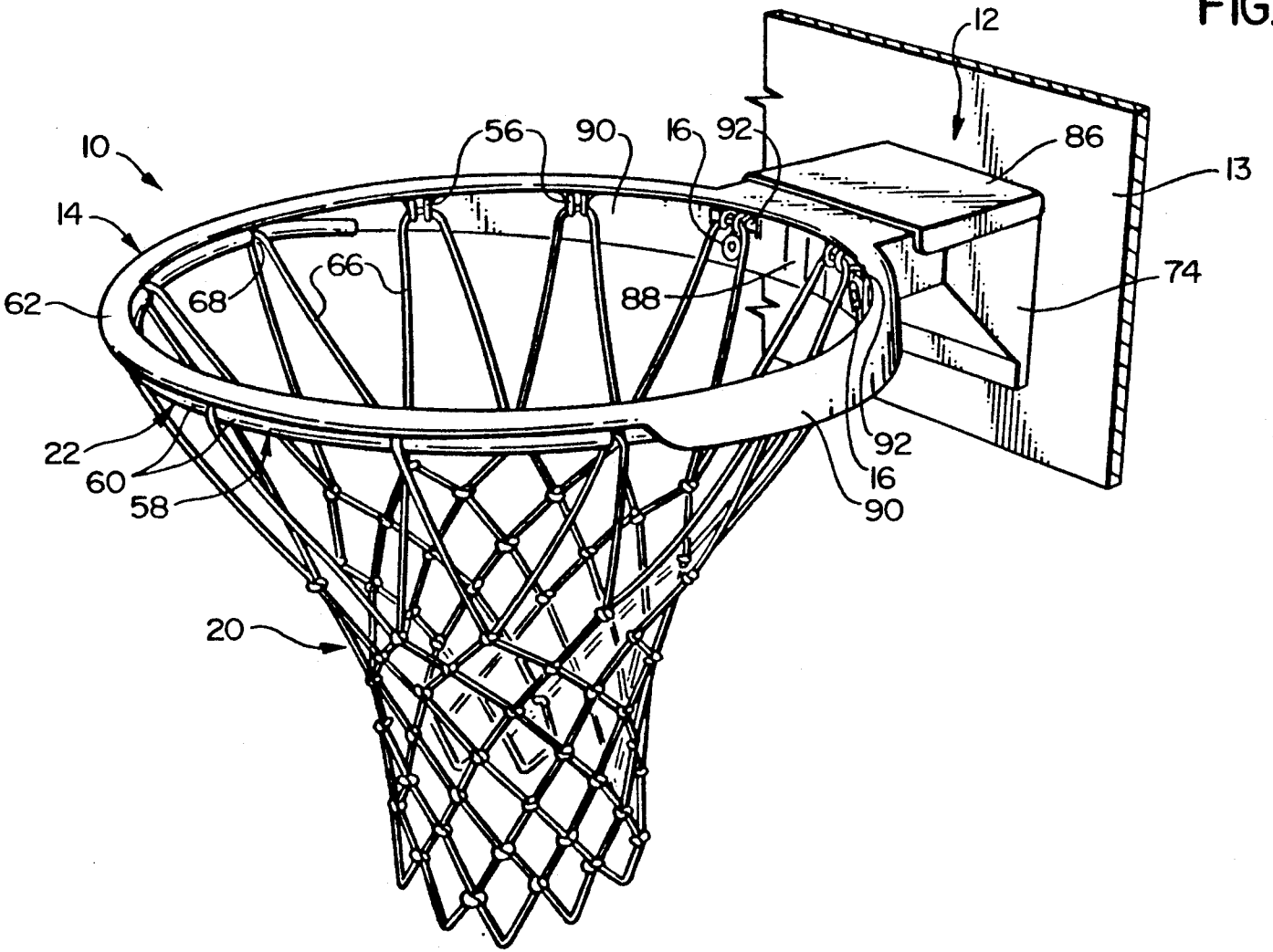
FIG. 1 is perspective view of a basketball rim assembly of the present invention.

Referring now to the drawing, depicted in FIG. 1 is basketball rim assembly 10 constructed in accordance with, and embodying, the principles of the present invention. In the following discussion, the term "front" will refer to the direction towards the bottom left in FIG. 1, towards the bottom in FIG. 2, and towards the left in FIGS. 3-9. The term "back" will refer to the direction towards the upper right in FIG. 1, towards the top in FIG. 2 and towards the right in FIGS. 3-9.

The rim assembly 10 of the present invention basically comprises a mounting portion 12 adapted to be attached to a basketball backboard 13, a rim portion 14 attached by bolts 16 and 18 (FIG. 3) to the mounting portion 12, a net 20, and a net fastener system 22 for attaching the net 20 onto the rim portion 14. The rim assembly 10 is of the breakaway type briefly described above in the Background of the Invention.

When bent, the rim portion 14 may be removed from the mounting portion 12 simply by removing the bolts 16 and 18. A new rim portion 14 may then be attached to the mounting portion 12 by reinserting the bolts 16 and 18. The present invention thus allows the relatively inexpensive rim portion 14 to be replaced while the relatively expensive mounting portion 12 may be used again.

Figure 3:
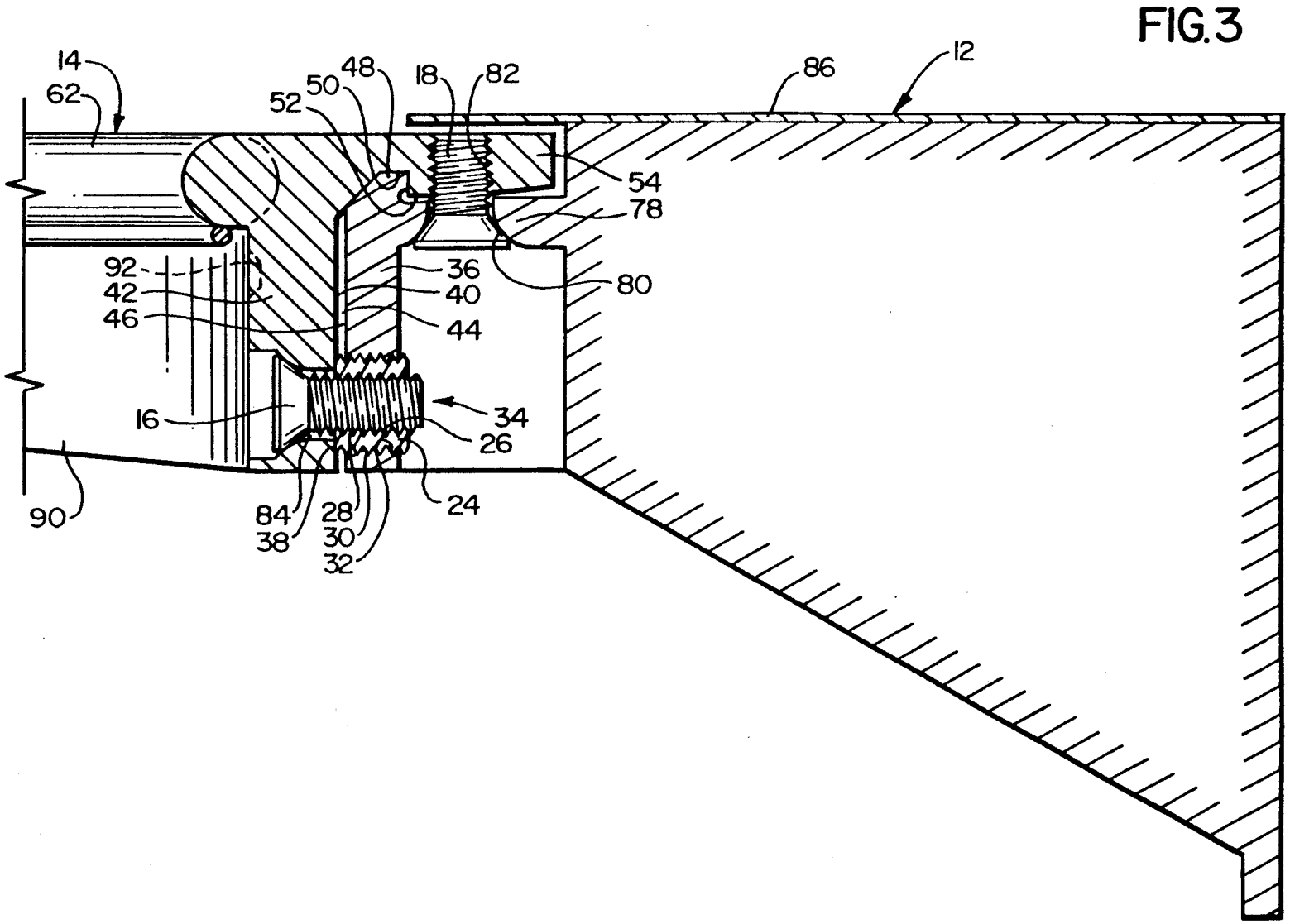
FIG. 3 is a side cut-away view taken along lines 3 in FIG. 2 depicting the means for attaching the rim portion of the rim assembly to the mounting portion thereof.
Figure 4:
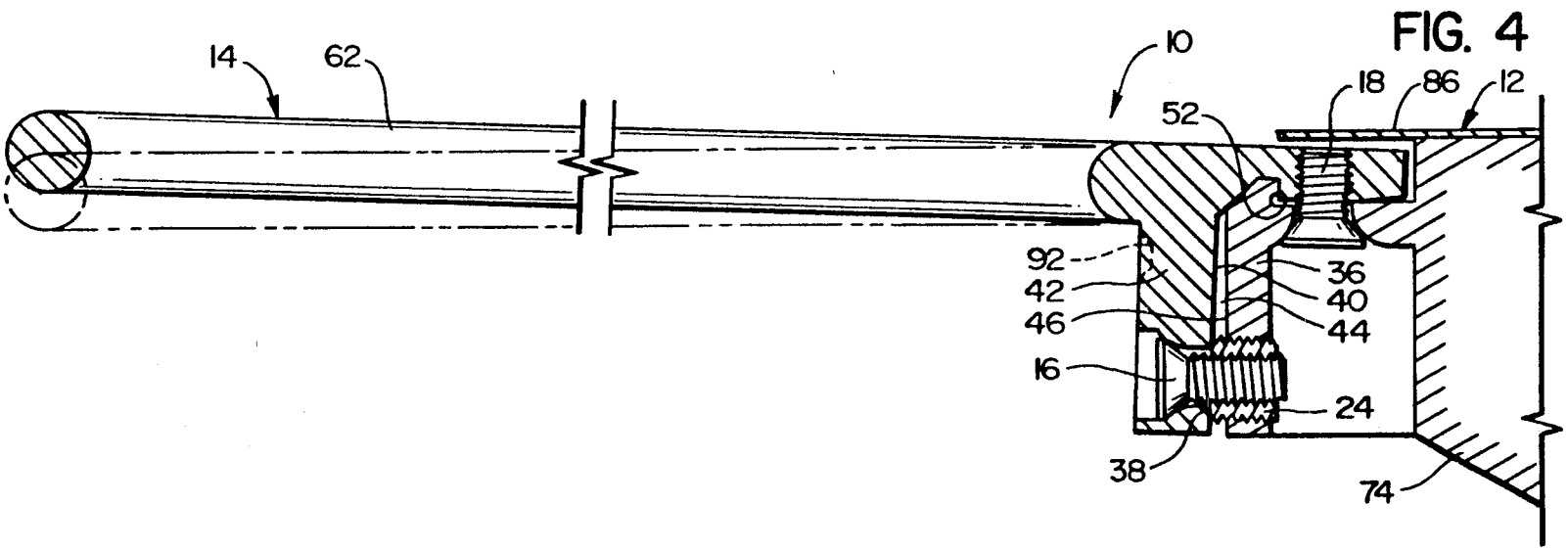
FIGS. 4 and 5 are side views of the rim assembly of the present invention showing the range of adjustment allowed by the rim angle adjustment sleeves thereof.
Figure 5:
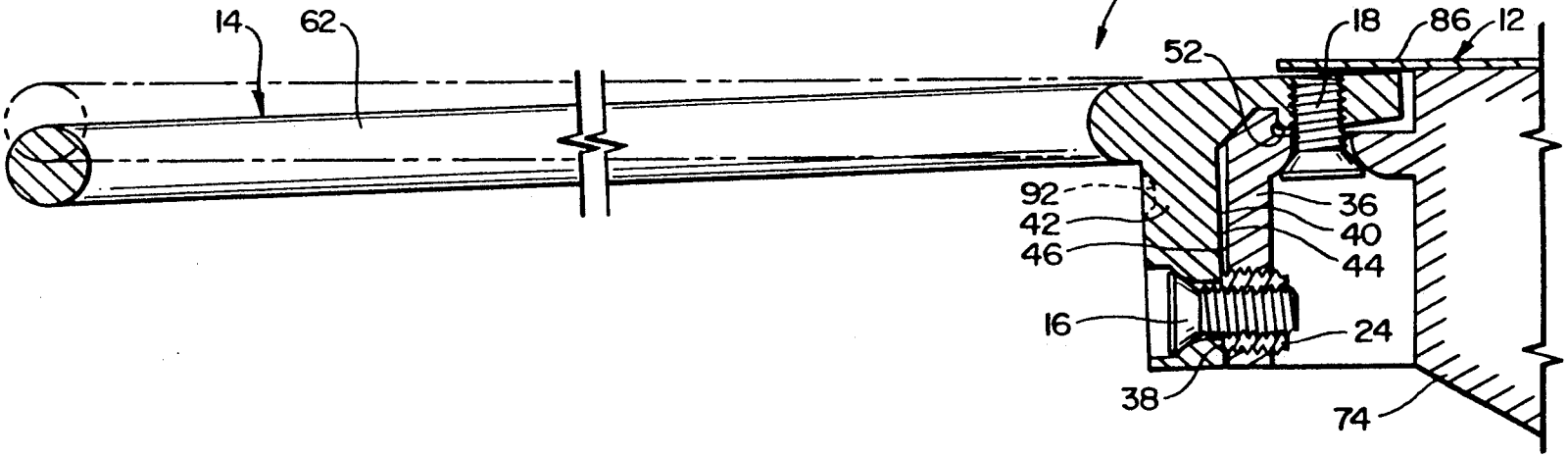
Figure 6:
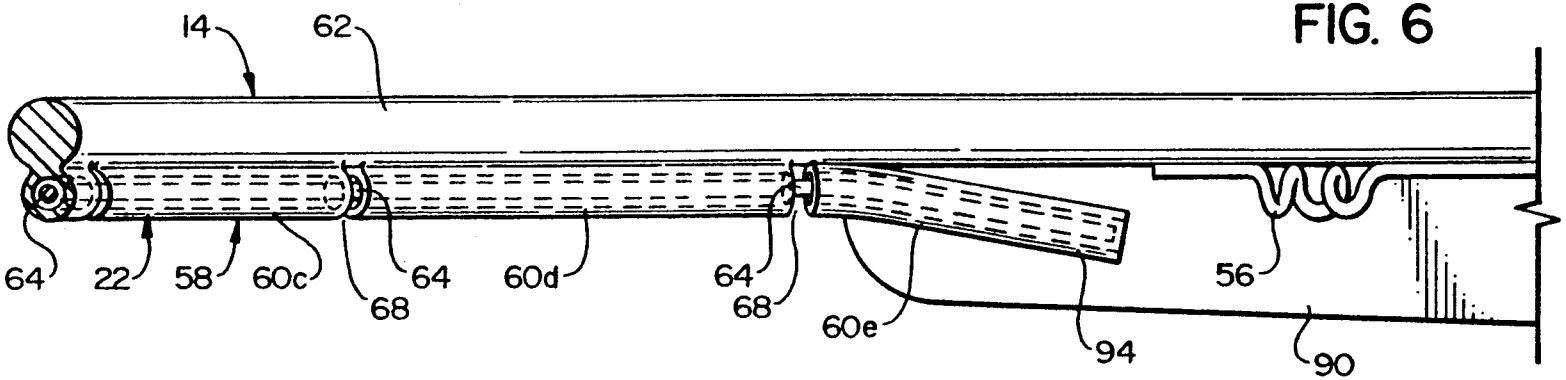
FIG. 6 is a side cut-away view taken along lines 6 in FIG. 2 depicting net fastening system of the present invention.

Another important feature of the present invention is the manner by which the bolts 16 are received and held by the mounting portion 12. Specifically, as shown in FIG. 3, cylindrical sleeves 24 are provided which are so threaded on their inner surfaces 26 that these inner surfaces 26 mate with the threaded portions 28 of the bolts 16. The outer surfaces 30 of these sleeves 24 are also threaded to be received within a threaded inner wall 32 of an orifice 34 in a front wall 36 of the mounting portion 12. When the rim portion 14 is attached to the mounting portion 12, a front edge 38 of the sleeves 24 abuts a back surface 40 of a back wall 42 of the rim portion 14. As shown in FIGS. 4 and 5, by turning the sleeve 24 within the orifice 34, a gap 44 between the back surface 40 and a front surface 46 of the mounting portion front wall 36 may be increased (FIG. 5) or decreased (FIG. 6). This allows the rim 14 to be adjusted as necessary to ensure that the it is horizontal.

The present invention further provides a pair of projections 48 located on the upper end of the mounting portion front wall 36. When the rim portion 14 is attached to the mounting portion 12, these projections 48 extend into grooves 50 formed in the bottom surface 52 of a rim plate 54 that rearwardly extends from the rim portion back wall 42. The projections 48 so engage the grooves 50 that loads applied to the rim portion 14 are transmitted directly to the mounting portion 12 as well as indirectly through the bolts 16 and 18.

Figure 7:
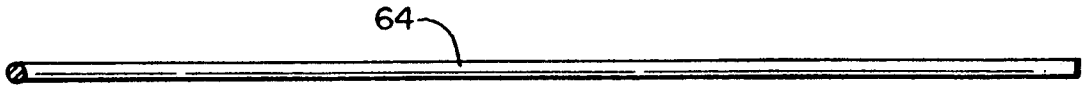
FIG. 7 is a side cut away view of the wire used by the net fastening system of the present invention.
Figure 8:
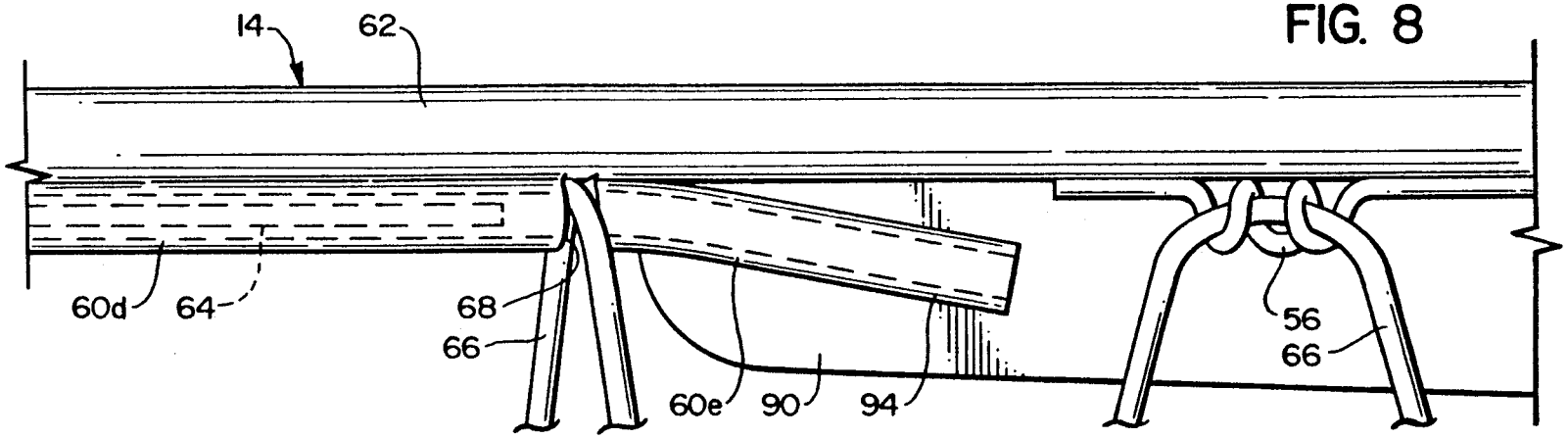
FIG. 8 is a side cut-away view of the method of attaching a net to the rim portion of the present invention.
Figure 9:
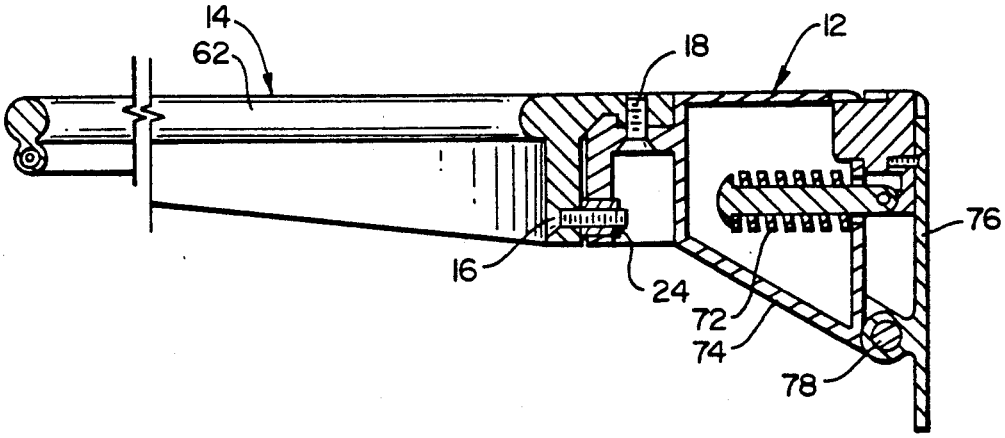
FIG. 9 is a side cut-away view depicting the damping/return spring of the breakaway system of the present invention.

The net fastener system 22 of the present invention is also of interest. As is best shown in FIGS. 6-8, this system 22 comprises a combination of a plurality of ram's horn type fasteners 56 and a tube/wire fastener 58. As its name implies, the tube/wire fastener 58 comprises a series of tubes 60 welded to the underside of a metal ring 62 of the rim portion 14 and a rigid wire 64 which extends through these tubes 60. As shown in FIG. 1, upper loops 66 of the net 20 are held in gaps 68 between the tubes 60 by the wire 64. The tube/wire fastener 58 extends around approximately two-thirds of the front of the metal ring 62. The tube/wire fastener 58 greatly lessens the possibility that players will injure their fingers on the fastener system used to attach the net 20 to the rim portion 14.

The traditional ram's horn type fasteners 56 are attached to the underside of the ring 62 along approximately the back one-third of the ring 62 not covered by the tube/wire fastener 58. These ram's horn fasteners are appropriate for the back one-third of the ring 62 because, among other reasons, players' fingers are much less likely to be injured near the back one-third of the ring 62 than near the front two-thirds of the ring 62.

The construction and method of use of the rim assembly 10 will now be described in further detail. As briefly discussed above, the rim assembly 10 is of the breakaway type. The apparatus that allows the rim portion 14 to break away and deflect downwardly is enclosed within the mounting portion 12. The breakaway apparatus is not itself part of the present invention and is relevant thereto primarily in that it is expensive relative to the rim portion 14. The breakaway apparatus within the mounting portion 12 thus will be described below only to the extent necessary for a full understanding of the present invention.

Figure 10:
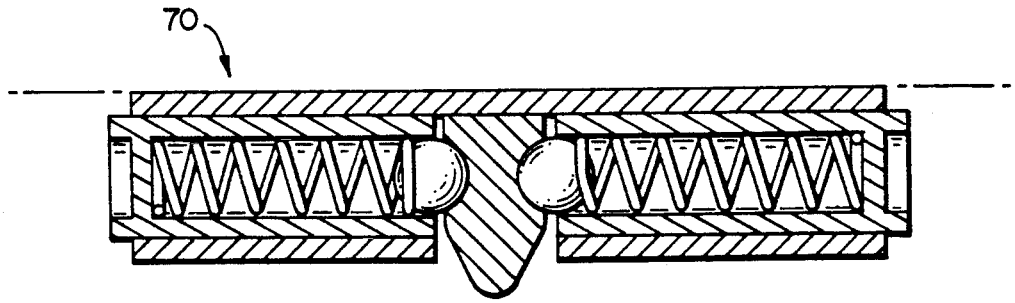
FIG. 10 is a front cut-away view of the detent system employed by the breakaway system of the present invention.

The breakaway apparatus is conventional and basically comprises: (a) a detent portion 70 (FIG. 10) which allows the rim to breakaway under a predetermined downward load on the rim portion 14; (b) a spring 72 (FIG. 9) which damps or absorbs the shock of such downward loads and returns the rim portion 14 to its original, unloaded position; and (c) a housing 74 pivotally attached to a mounting wall 76 that is attached to the backboard 13 by a hinge 78. Such a breakaway apparatus is described in detail, for example, in U.S. Pat. No. 4,433,839 issued to Simonseth, which is incorporated herein by reference. Essentially, when sufficient downward force is applied to the housing 74, the detent 70 releases and the housing 74 rotates downwardly about the pivot point 76. The spring 72 is mounted so that it opposes downward rotation of the housing 74 and forces the housing 74 back into its original position after the force thereon is removed.

The mounting portion front wall 36 described above is rigidly attached to a plate 78 extending from the front of the mounting portion housing 74. The front wall 36 thus downwardly rotates with the housing 74. The above-mentioned bolts 18 are inserted through holes 80 in the plate 78 extending from the housing 74 and are received in threaded holes 82 in the rim plate 54. The above-mentioned bolts 16 are inserted through holes 84 in the back wall 42 and threaded into the sleeves 24. The bolts 16 and sleeve 24, the bolts 18, and the above-mentioned projections 48 transmit downward loads on the rim portion 14 to the mounting portion housing 74. Therefore, when excessive loads are applied to the rim portion 14, the breakaway apparatus allows the rim portion 14 to deflect downwardly and dampens the shocks transmitted to the backboard 13. In the rim assembly 10, the bolts 16 and 18 and projection 48 are designed to be of sufficient thickness to withstand the maximum expected loads that will be applied to the rim portion 14.

Even though the breakaway apparatus allows the rim portion 14 to deflect downwardly, the loads applied to this rim portion 14 may be sufficient to cause the rim portion 14 to bend. If this occurs, the bent rim portion 14 may be removed from the mounting portion 12 simply by removing a cover 86 of the housing 74 and the bolts 16 and 18. A new rim portion 14 may then be procured and mounted on the mounting portion 12. This is accomplished by arranging the new rim 14 so that the grooves 50 thereon receive the projections 48 on the mounting portion 12, inserting the bolts 16 through the holes 84 and threading these bolts 16 into the sleeves 24, inserting the bolts 18 through the holes 80 and threading these bolts 18 into the holes 82, and replacing the cover 86.

If for any reason the rim portion ring 62 is not properly angularly aligned with respect to the backboard and/or the playing surface, the angle at which this rim portion 14 extends from the mounting portion 12 may be adjusted by rotating the sleeves 24 within the holes 26 in the mounting portion front wall 36. More particularly, the bolts 18 are loosened or removed and the bolts 16 are removed. Because the front edges 38 of the sleeves 24 abut the back surface 40 of the rim portion back wall 42, rotating these sleeves 24 causes the entire rim portion 14 to rotate about a pivot axis near the projections 48. When the ring 62 is properly angularly aligned with the backboard and/or playing surface, the bolts 16 are then reinserted and the bolts 18 are reinserted or tightened.

To allow this adjustment process, the holes 84 and 80 should be formed so that the heads of the bolts 16 and 18 are securely received therein even though the angle at which these bolts 16 and 18 extend through the back wall 42 varies with the adjustment process. Similarly, the bottom surface 52 of the rim back portion 54 should be tapered towards the back to facilitate this adjustment process.

Figure 2:
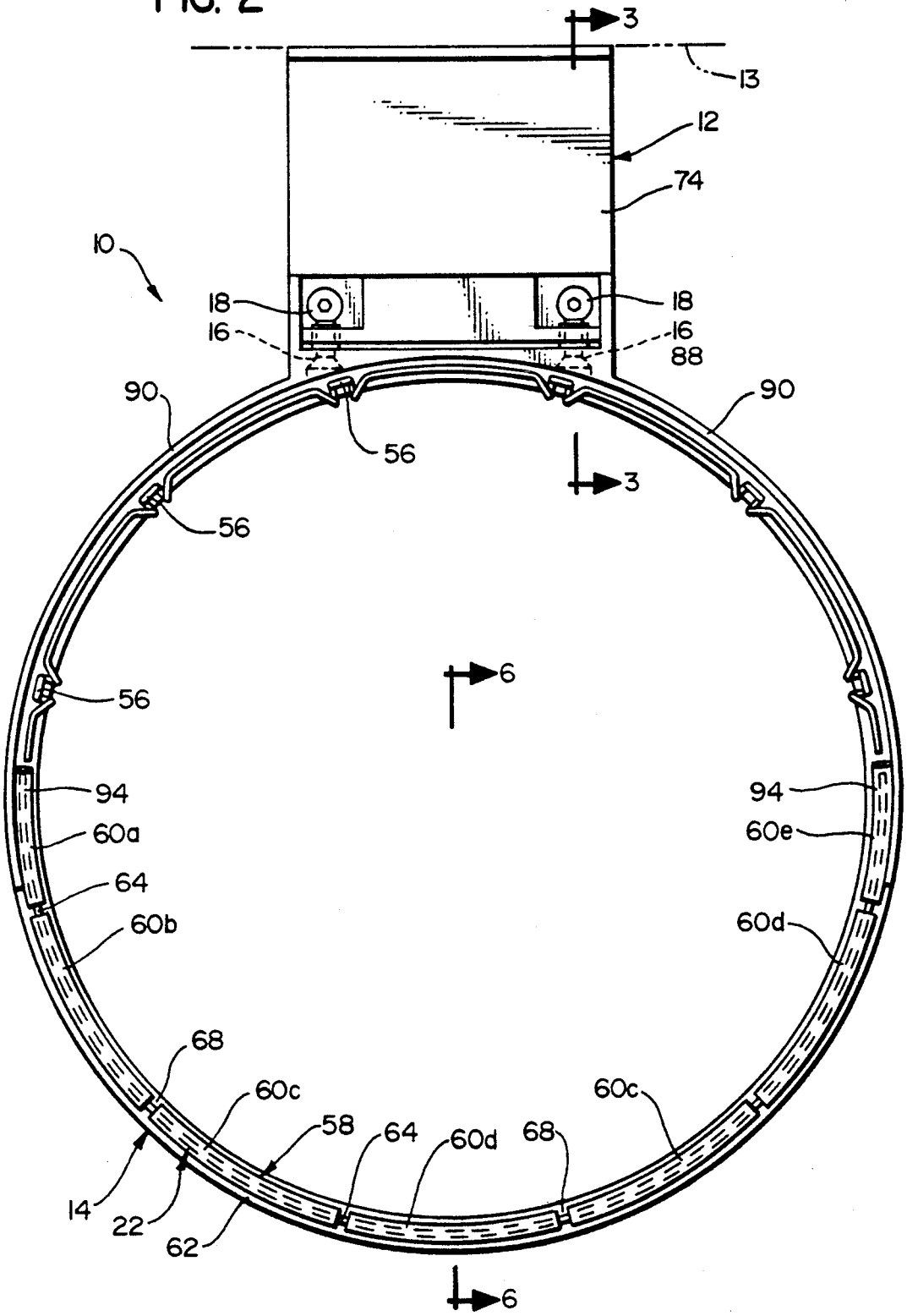
FIG. 2 is a bottom view of the rim assembly depicted in FIG. 1.

The rim portion 14 will now be discussed in further detail with reference to FIGS. 1 and 2. The rim portion 14 basically comprises the metal ring 62, the net fastener system 20, a back portion 88, and a pair of reinforcing members 90. The back portion 88 is welded to the back of the ring 62. The back portion 88 comprises the back wall 42 and plate 54 and allows the ring 62 to be mounted onto the mounting portion 12. Preferably, recesses are formed on the front surface 92 of the rim portion back wall 42 to allow the upper loops 66 of the net 20 to be more easily placed over the ram's horn style net fasteners 56 located near the back portion 88.

The reinforcing members 90 are welded to the ring 62 and the back portion 88. These members 90 provide structural strength to the ring 62 against downward loads thereon and also shield player's fingers from the ram's horn style fasteners 56.

The net fastener system 20 comprises the tube/wire fastener 58 and six ram's horn style fasteners 56. The ram's horn style fasteners are well-known in the art and will not be described in further detail. The tubes 60 of the tube wire fastener 58 are hollow, arcuate tubes welded to the under side of the ring 62. The length and position of these tubes 60 is determined so that the gaps 68 therebetween occur at the points where the upper loops 66 of the net 20 are to be attached to the ring 62. Additionally, the back portions 94 of the back-most tubes 60*a* and 60*e* are downwardly bent to retain the wire 64 within the tubes 60, as will be discussed in more detail below.

The wire 64 is an arcuate, rigid wire having the same radius of curvature as the ring 62. To attach the net 20 to the ring 62, an upper loop 66 of the net 20 is first placed into one of the gaps between the tube 60*a* and the tube 60*b* adjacent thereto. The wire 64 is then inserted into the tube 60*a* and slid therethrough until the wire passes underneath the loop 66. The wire 64 is then further inserted until it enters the tube 60*b*, at which point the loop 66 is securely attached to the ring 62.

This process is repeated for adjacent loops 66. As shown in FIG. 8, an appropriate loop 66 is inserted into the gap 68 between the tubes 60*d* and 60*e*, after which the wire is slid through the tube 60*d* into the tube 60*e*. When the wire 64 is inserted through all of the tubes 60, its ends are downwardly deflected, as shown in FIG. 6, by the bent back portions 94 of the back-most tubes 60*a* and 60*e*. This downward deflection spring-loads or tensions the wire 64 in a manner that ensures the wire 64 will stay within the tubes 60.

From the foregoing, it should be clear that the present invention may be embodied in forms other than that disclosed above without departing from the spirit or essential characteristics of the present invention. The above-described embodiment is therefore to be considered in all respects illustrative and not restrictive, the scope of the invention being indicated by the appended claims rather than the foregoing description. All changes that come within the meaning and scope of the claims are intended to be embraced therein.

I claim:

1. A basketball rim assembly, comprising:

a. a mounting portion comprising i. a mounting wall adapted to be rigidly attached to a backboard, ii. a housing portion adapted to be attached to the mounting wall in a manner that allows the housing portion to rotate relative to the mounting wall about a pivot point, the housing portion having a first bearing portion;

b. a rim portion comprising a ring and a back portion having a second bearing portion, where the back portion is adapted to be so attachable to the housing portion that the second bearing portion is adjacent to the first bearing portion;

c. release means mounted within the housing, the release means comprising i. means for releaseably connecting the housing portion to the mounting wall in a manner that allows the mounting portion to rotate about the pivot point when downward loads on the ring exceed a predetermined amount, and ii. means for opposing rotation of the housing portion about the pivot point caused by downward loads on the ring; and d. first fastening means for detachably attaching the rim portion to the housing portion along a first fastening axis; wherein when a downward force is applied to the ring, the second bearing portion is urged towards and contacts the first bearing portion and the first fastening means is so arranged relative to the first and second bearing portions that a force applied by the rim portion on the first fastening means subjects the first fastening means primarily to shear loads.

2. A basketball rim assembly as recited in claim 1, in which the first fastening means is so arranged relative to the first and second bearing portions that the direction in which the force applied by the rim portion on the first fastening means is substantially orthogonal to the first fastening axis.

3. A basketball rim assembly as recited in claim 1, in which:

a. the mounting portion has a third bearing portion; and b. the rim portion has a fourth bearing portion so located adjacent to the third bearing portion that, when downward forces are applied to the ring, the fourth bearing portion is urged towards the third bearing portion.

4. A basketball rim assembly as recited in claim 3, in which the third and fourth bearing portions are so arranged relative to the first and second bearing portions that the fourth bearing portion is urged towards the third bearing portion in a direction that is substantially orthogonal to the first fastening axis.

5. A basketball rim assembly as recited in claim 4, in which the first fastening means is so arranged relative to the first and second bearing portions that the direction in which the force applied by the rim portion on the first fastening means is substantially orthogonal to the first fastening axis.

6. A basketball rim assembly as recited in claim 1, in which one of the first and second bearing portions is so movable relative to a respective one of the mounting portion and the rim portion that an angle at which the ring extends from the backboard may be adjusted.

7. A basketball rim assembly as recited in claim 6, in which:

a. the one of the first and second bearing portions that is movable is formed on an angle adjusting member having external threads; and b. a threaded orifice adapted to receive the angle adjusting member is so formed in one of the mounting portion and the rim portion that the angle adjusting member may be rotated within the threaded orifice to adjust the angle at which the ring extends from the backboard.

8. A basketball rim assembly as recited in claim 1, further comprising a second fastening means for detachably interconnecting the rim portion to the mounting portion along a second fastening axis, the second fastening means be arranged to urge the first and second bearing locations together.

9. A basketball rim assembly as recited in claim 8, in which the second fastening axis extends through the first and second bearing portions.

10. A basketball rim assembly as recited in claim 9, in which one of the first and second bearing portions is so movable relative to a respective one of the mounting portion and the rim portion that an angle at which the ring extends from the backboard may be adjusted.

11. A basketball rim assembly as recited in claim 10, in which:

a. the one of the first and second bearing portions is formed on an angle adjusting sleeve having internal and external threads;

b. a threaded orifice adapted to matingly receive the external threads of the angle adjusting member is so formed in one of the mounting portion and the rim portion that the angle adjusting member may be rotated within the threaded orifice to adjust the angle at which the ring extends from the backboard; and c. the second fastening means comprises a bolt means having external threads, the bolt member extending though a hole in the other of the mounting portion and the rim portion, where the external threads of the bolt means are matingly received by the internal threads of the angle adjusting sleeve.

12. A basketball rim assembly, comprising:

a. a mounting portion adapted to be attached to a backboard;

b. a rim portion comprising a ring and a back portion where the back portion is adapted to be so attached to the mounting portion that a first bearing portion on the mounting portion is adjacent to a second bearing portion on the back portion and a third bearing portion on the mounting portion is adjacent to a fourth bearing portion on the back portion; wherein when a downward force is applied to the ring, the second bearing portion is urged towards the first bearing portion and the fourth bearing portion is urged towards the third bearing portion; and the third and fourth bearing portions are so arranged relative to the first and second bearing portions that the second bearing portion is urged towards the first bearing portion in a direction that is substantially parallel to the direction in which the fourth bearing portion is urged towards the third bearing portion;

the basketball rim assembly further comprising a fastening means for detachably interconnecting the rim portion to the mounting portion along a fastening axis, the fastening axis extending substantially orthogonal to the direction in which the fourth bearing portion is urged towards the third bearing portion.

13. A basketball rim assembly, comprising:

a. a rim portion having a ring with a lower surface;

b. a mounting portion attached to the rim portion, the mounting portion being adapted to be attached to a backboard;

c. a plurality of tubes mounted on the lower surface of a ring with gaps between adjacent tubes, where the tubes are arranged with openings extending therethrough substantially parallel to the ring; and d. an elongate member adapted to be inserted through the tubes; wherein a net is suspended from the rim portion by placing an upper loop of the net in a gap between any given pair of adjacent tubes and inserting the elongate member through the given pair of adjacent tubes underneath the loop so that the loop is securely held by the elongate member; and the length and position of the tubes is so determined that the gaps between adjacent tubes occur at the points where the upper loops of the net are to be attached to the ring.

* * * * *